US012582253B2

(12) United States Patent
Colantonio et al.

(10) Patent No.: US 12,582,253 B2
(45) Date of Patent: Mar. 24, 2026

(54) SELF-RIGHTING HYDRATION CUP HOLDER

(71) Applicant: United States Government As Represented By The Department of Veterans Affairs, Washington, DC (US)

(72) Inventors: Cheryl L. Colantonio, Tampa, FL (US); Brian W. Burkhardt, Tampa, FL (US)

(73) Assignee: United States Government as represented by the Department of Veterans Affairs, Washington, DC (US)

( * ) Notice: Subject to any disclaimer, the term of this patent is extended or adjusted under 35 U.S.C. 154(b) by 0 days.

(21) Appl. No.: 18/421,587

(22) Filed: Jan. 24, 2024

(65) Prior Publication Data

US 2024/0245244 A1 Jul. 25, 2024

Related U.S. Application Data

(60) Provisional application No. 63/481,260, filed on Jan. 24, 2023.

(51) Int. Cl.
*A47G 23/00* (2006.01)
*A47G 23/02* (2006.01)

(52) U.S. Cl.
CPC .... *A47G 23/0225* (2013.01); *A47G 2400/086* (2013.01)

(58) Field of Classification Search
None
See application file for complete search history.

(56) References Cited

U.S. PATENT DOCUMENTS 3,734,439 A * 5/1973 Wintz ..... A47G 23/0241 248/230.8
4,535,923 A * 8/1985 Manke ..... B60N 3/103 224/272
4,887,784 A * 12/1989 Kayali ..... F16M 13/022 248/231.51
5,014,956 A * 5/1991 Kayali ..... B60N 3/106 248/311.2
5,301,858 A * 4/1994 Hollander ..... B62J 9/22 224/660
5,320,263 A * 6/1994 Kobylack ..... A63B 55/408 224/558
6,045,017 A * 4/2000 Connell ..... A45F 5/02 224/675
7,959,121 B1 * 6/2011 Barnes, Jr. ..... A47G 23/0225 248/311.2
8,231,094 B1 * 7/2012 Barnes, Jr. ..... A47G 23/0225 248/311.2
8,757,573 B1 * 6/2014 Barnes, Jr. ..... A47G 23/0225 224/558

(Continued)

*Primary Examiner* — Steven M Marsh
(74) *Attorney, Agent, or Firm* — Ballard Spahr LLP

(57) ABSTRACT

An assembly can be configured to couple to an attachment structure. The assembly can comprise a cup holder having a top opening and defining an interior that is configured to receive and hold at least a portion of a cup. A bracket can be pivotably coupled to the cup holder about a horizontal axis so that the top opening faces upwardly. The bracket can comprise a coupling structure that is configured to couple to an attachment structure.

18 Claims, 6 Drawing Sheets

(56) References Cited

U.S. PATENT DOCUMENTS

| | | | | |
|---|---|---|---|---|
| 10,932,577 | B2 * | 3/2021 | Dobson | A47C 7/624 |
| 10,981,654 | B2 * | 4/2021 | Slack, Jr. | A47G 23/0225 |
| 2001/0032866 | A1 * | 10/2001 | Gagne | A45F 5/021 224/269 |
| 2010/0084531 | A1 * | 4/2010 | Schuchman | B60N 3/103 248/311.2 |
| 2023/0030769 | A1 * | 2/2023 | Gu | A47G 23/0225 |
| 2023/0180953 | A1 * | 6/2023 | Gu | A47G 23/0225 220/737 |

* cited by examiner

SELF-RIGHTING HYDRATION CUP HOLDER

CROSS-REFERENCE TO RELATED APPLICATION

The present application claims the benefit of U.S. Provisional Application No. 63/481,260 filed Jan. 24, 2023 and entitled "SELF-RIGHTING HYDRATION CUP HOLDER", the disclosure of which, including all appendices, is hereby incorporated by reference in its entirety.

FIELD

This disclosure relates to cup holders for individuals having neurologic and/or physiological conditions that make it difficult to position a cup or straw.

BACKGROUND

Individuals such as those with neurologic or other physiological conditions often have difficulty meeting their hydration needs, for example, in a hospital, nursing home, or other caretaking environment. For example, an individual with paralysis often requires a caregiver to position a cup or straw at her mouth. Accordingly, such individuals require frequent care and can suffer from urinary infections, dehydration, and hypotension as a result of inadequate hydration.

SUMMARY

Described herein, in various aspects, is an assembly for coupling to an attachment structure. The assembly can comprise a cup holder having a top opening and defining an interior that is configured to receive and hold at least a portion of a cup. A bracket can be pivotably coupled to the cup holder about a horizontal axis so that the top opening faces upwardly. The bracket can comprise a coupling structure that is configured to couple to an attachment structure.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1A:
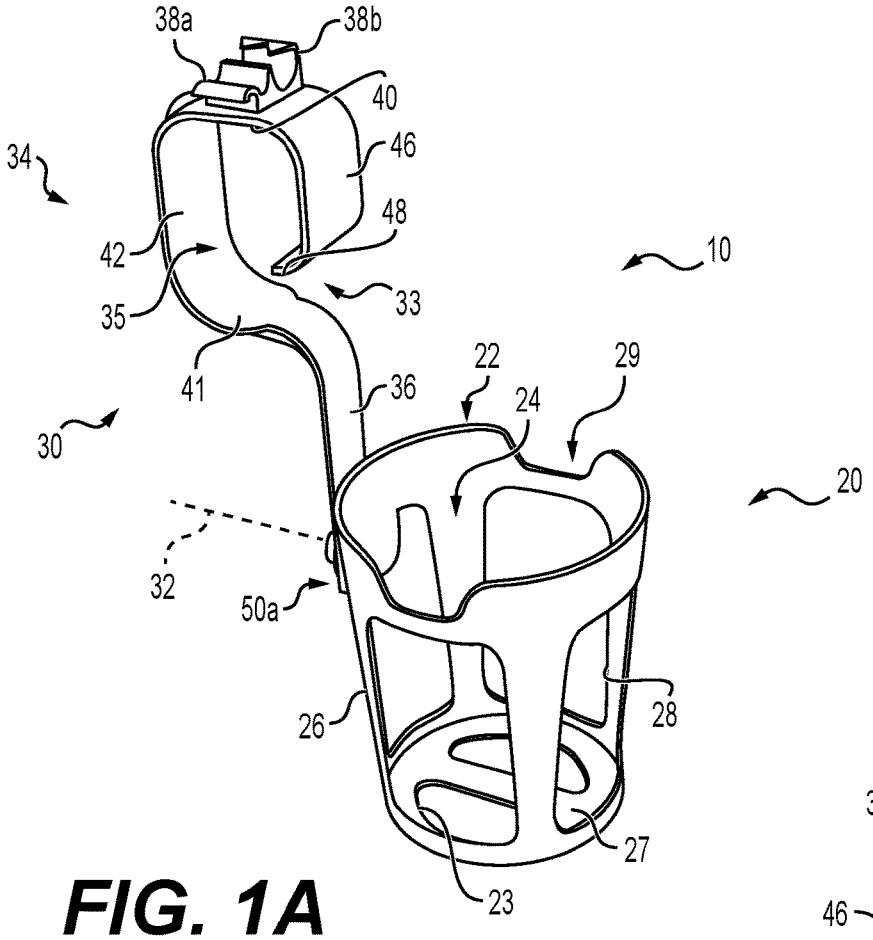
FIGS. 1A and 1B are front and rear perspective views of an exemplary cup holder assembly in accordance with an embodiment of the present invention.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" can optionally include plural referents unless the context clearly dictates otherwise. For example, use of the term "a bracket" can refer to a single bracket and can also represent disclosure of embodiments in which a plurality of such brackets are provided.

All technical and scientific terms used herein have the same meaning as commonly understood to one of ordinary skill in the art to which this invention belongs unless clearly indicated otherwise.

As used herein, the terms "optional" or "optionally" mean that the subsequently described event or circumstance may or may not occur, and that the description includes instances where said event or circumstance occurs and instances where it does not.

The word "or" as used herein means any one member of a particular list and, except where otherwise indicated, in alternative aspects, can also represent disclosure of embodiments that include any combination of members of that list.

As used herein, the term "at least one of" is intended to be synonymous with "one or more of." For example, "at least one of A, B and C" explicitly includes only A, only B, only C, and combinations of each.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, if further aspects, when values are approximated by use of "approximately," "substantially," and "generally," it is contemplated that values within up to 15%, up to 10%, up to 5%, or up to 1% (above or below) of the particularly stated value can be included within the scope of those aspects. In still further aspects, when angular relationships (e.g., "parallel" or "perpendicular") are approximated by use of "approximately," "substantially," or "generally," it is contemplated that angles within 15 degrees (above or below), within 10 degrees (above or below), within 5 degrees (above or below), or within 1 degree (above or below) of the stated angular relationship can be included within the scope of those aspects.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Figure 1B:
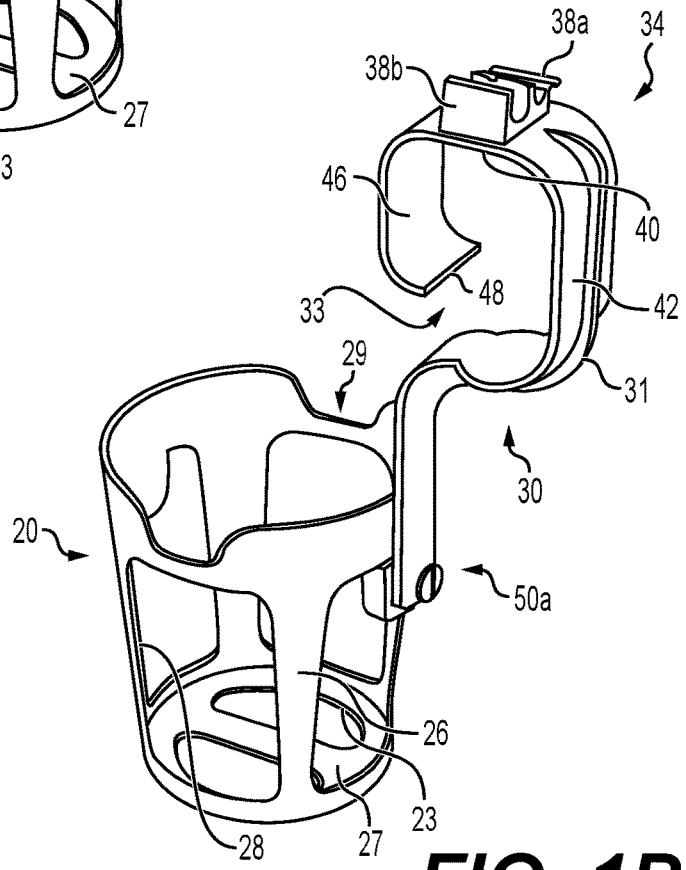

Referring now to FIGS. 1A and 1B, disclosed herein is a cup holder assembly 10 for providing a receptacle (e.g., a cup holder) coupled to an attachment structure, such as a side rail 11 of a hospital bed 15 (FIG. 5), to facilitate access to the cup or items disposed therein by a person disposed in the hospital bed 15. Although described herein as a "cup holder," it is contemplated that the assembly 10 serving as the cup holder can be configured to hold items other than cups such as, but not limited to, cell phones, pens and pencils, medications, and the like. Other exemplary attachment structures can include, for example and without limitation, armrests of a chair, bed, or wheelchair, portions of the frame of a chair or bed, support rails secured to a wall, and the like.

As noted, the cup holder assembly 10 can be configured to couple to an attachment structure, such as, for example and without limitation, a side rail 11 of a hospital bed 15. The assembly 10 can comprise a cup holder portion 20 having a top opening 22 and defining an interior 24 that is configured to receive and hold at least a portion of a cup or other fluid receptacle. Preferably, the interior 24 of the cup holder portion 22 is sized and configured to slidably receive a standard size hospital hydration jug 70 therein, the typical hydration jug being configured to hold 32 fluid ounces (e.g., having a diameter ranging from about 3 inches to about 5 inches and a height ranging from about 8 inches to about 15 inches). As can be appreciated, varying sizes and shapes of the cup holder portion 20 can be provided for complementary receipt of particular bottles or jugs.

A bracket portion 30 of the assembly 10 can be pivotably coupled to the cup holder portion 20 about a horizontal pivot axis 32 so that the top opening 22 of the cup holder portion 20 faces upwardly regardless of the angle at which the side rail 11 is disposed. For example, when the bed 15 is configured so that the patient is in a partially-reclined position, such as when watching television, the cup holder portion 20 remains in a vertical orientation. The bracket portion 30 preferably comprises a coupling structure 34 that is configured to be releasably coupled to the side rail 11 of the hospital bed 15. For example, as shown in FIGS. 1A and 1B, the coupling structure 34 is provided in the form a resiliently bendable hook, as described further below. Other exemplary coupling structures include, for example and without limitation, a selectively closeable sleeve, bracket, or ring coupling having segments that can be closed together around a portion of a side rail or secured directly to the side rail using fasteners, such as bolts. Still other exemplary coupling structures include magnetic connectors or releasable mechanical connectors (e.g., hook and loop fasteners) that are provided on the bracket portion 30 and that are configured for complementary attachment to corresponding connectors associated with the side rail of the hospital bed.

Figure 4:
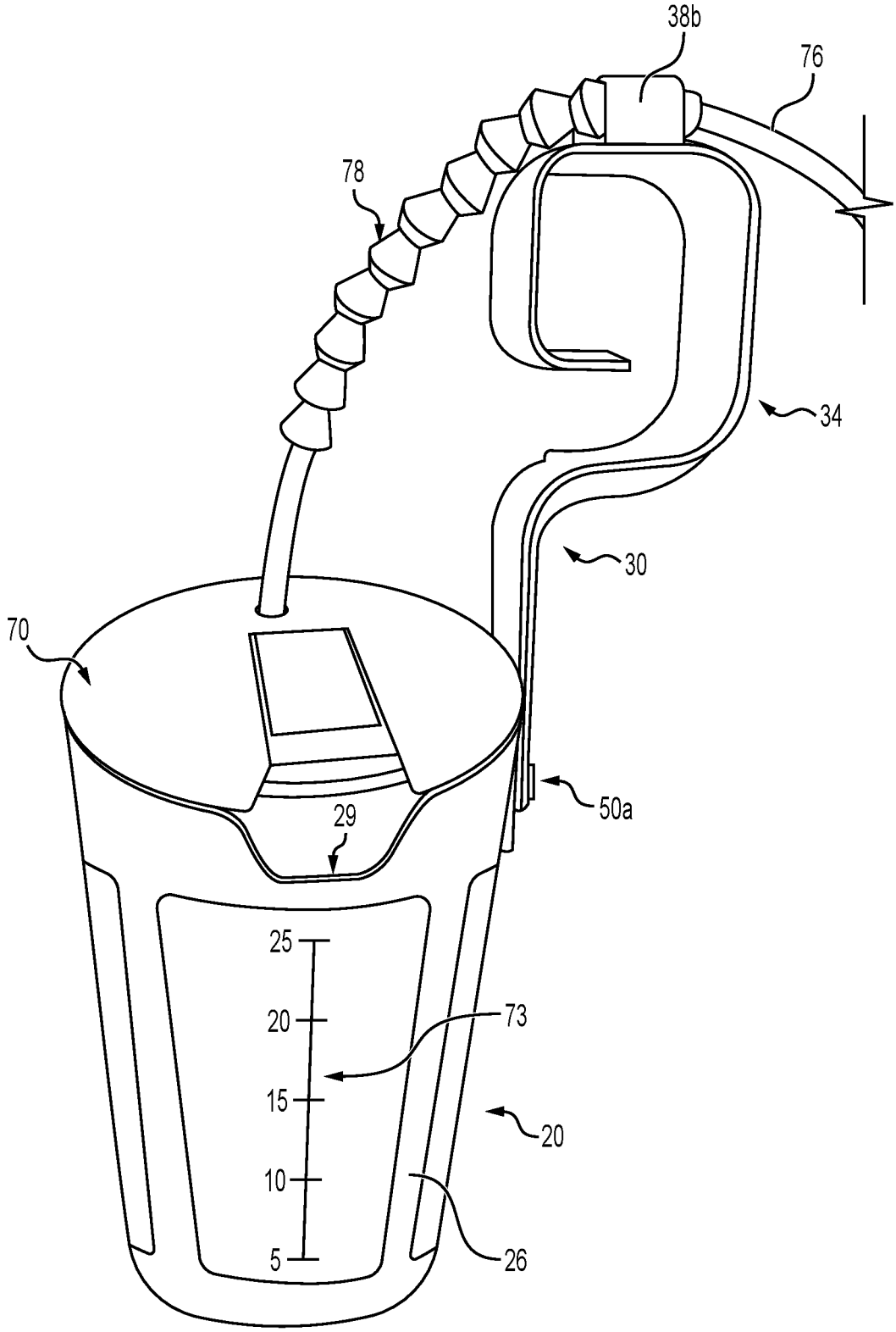
FIG. 4 is a perspective view of the cup holder assembly shown in FIGS. 1A and 1B supporting a corresponding hospital hydration jug and a straw.

The interior 24 of the cup holder portion 20 of the assembly 10 is configured to receive and hold at least a portion of hospital hydration jug 70, or other fluid container, therein. As shown in FIGS. 1A and 1B, the side wall 26 of the cup holder portion 20 is slightly frustoconical in shape and preferably defines a plurality of apertures 28 therein. The apertures 28 facilitate the patient or caregiver being able to view the graduated measurements 73 that are typically provided on standard hospital hydration jugs 70, as shown in FIG. 4. As such, the apertures 28 allow the caregiver or patient to monitor the patient's fluid intake without removing the hydration jug 70 from the assembly 10. The upper perimeter of the side wall 26 of the cup holder portion 20 preferably defines a pair of recesses 29 therein to facilitate the removal of a hydration jug 70 therefrom. Additionally, the bottom wall 27 of the cup holder portion 20 may include apertures 23 formed therein to prevent the accumulation of fluids in the cup holder portion 20.

Figure 5:
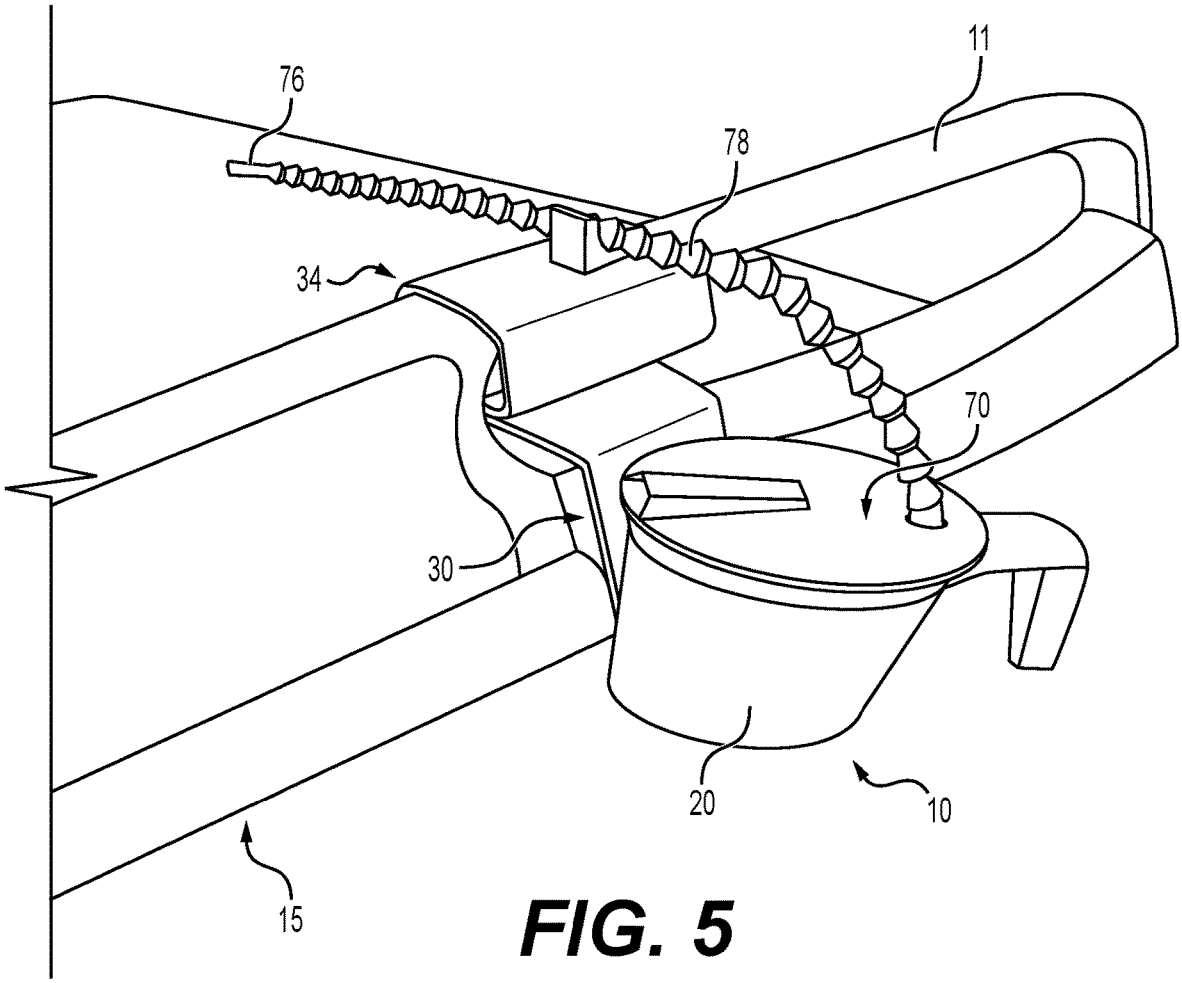
FIG. 5 is the cup holder assembly shown in FIGS. 2A and 2B, attached to a side rail of a corresponding hospital bed.

The bracket portion 30 preferably includes a pair of straw retaining features 38*a* and 38*b* that are each configured to releasably receive and hold a straw therein. In the embodiment shown, the first and second straw retaining features 38*a* and 38*b* are each configured to releasably retain different sized straws. For example, the first straw retaining feature 38*a* can comprise a hook defining a semi-cylindrical interior space. As such, the first straw retaining feature 38*a* is configured to releasably receive a typical cylindrical straw. Preferably, the second straw retaining feature 38*b* is configured to releasably receive a portion of a modular hose 78 therein (FIG. 5). A modular hose 78, such as a LOC-LINE® modular hose, allows a user or caregiver to form a desired shape for access by the patient, and the modular hose 78 retains that shape, as shown in FIGS. 4 and 5.

In some aspects, the coupling structure 34 can comprise a resilient hook 34 at least partially defining an inner volume 35 that is configured to receive a portion of the side rail 11 of the bed 15 therein (FIG. 5). For example, the hook 34 can comprise a first portion 40 that is configured to rest on the top of the attachment structure, or side rail 11, and a first side wall 46 that extends downwardly from the distal end of the first portion 44. The hook 34 can further comprise an inwardly extending projection 48 that extends both underneath and parallel to the first portion 40 so that the projection 48 is disposed adjacent the bottom surface of the side rail 11 when attached. A second side wall 42 extends downwardly from a proximal end of the first portion 44 to a bottom flange 41 that extends outwardly from the body portion 36 of the bracket portion 30. The bottom flange 41 is provided so that the body portion 36 and, therefore, attached cup holder portion 20, remain clear of the bed and hang vertically when the hook 34 is attached to the side rail 11. As noted, the shape of the interior volume 35 of the hook 34 corresponds substantially to the cross-sectional shape of the corresponding side rail 11 of the bed 15. The coupling structure 34 is preferably resiliently deformable to receive the side rail 11 therein. The gap 33 formed between the inwardly extending projection 48 and the bottom flange 41 is sized to enable the hook 34 to be deformed while receiving the bed rail 11 of the hospital bed 15 therein without causing damage to the resilient hook 34. Optionally, a strengthening rib 31 may be provided along the length of the bracket portion 30 for additional rigidity if desired.

Figure 2A:
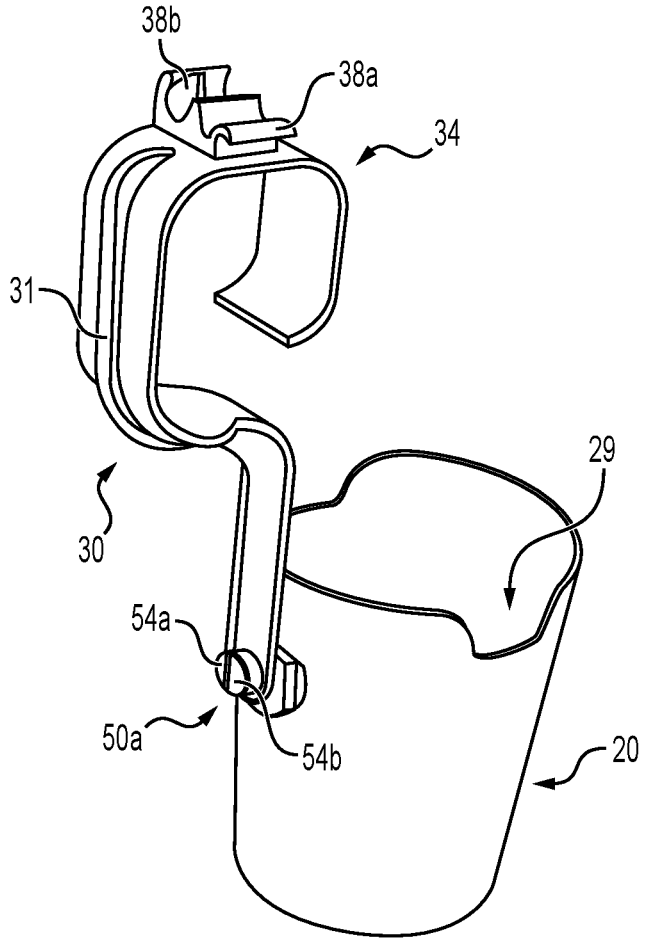
FIGS. 2A and 2B are front perspective views of an exemplary cup holder assembly in accordance with an alternate embodiment of the present invention.
Figure 2B:
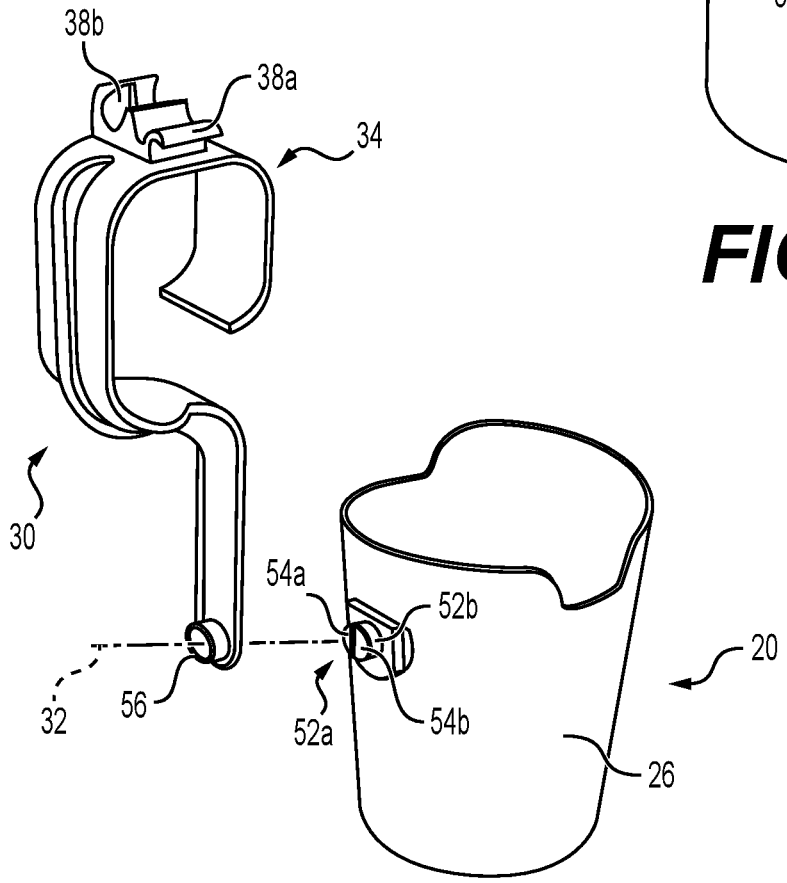

Referring additionally to FIGS. 2A and 2B, preferably, the bracket portion 30 is removably and pivotably coupled to the cup holder portion 20. For example, as shown, the cup holder assembly 10 preferably includes a releasable retention feature 50*a* in the form of a split post 52*a* and 52*b* that is releasably received in a correspondent cylindrical aperture 56 defined in the bottommost portion of the bracket portion 30. As shown, each portion 52*a* and 52*b* of the split post includes an outwardly depending radial tab 54*a* and 54*b* at its distal end. To connect the cup holder portion 20 to the bracket portion 30, the user presses the radial tabs 54*a* and 54*b* of the split post 52*a*, 52*b* against the cylindrical wall that defines the aperture 56. Interaction between the radial tabs 54*a* and 54*b* and the perimeter of the aperture 56 causes the distal ends of the split post portions 52*a* and 52*b* to be urged inwardly until the radial tabs 54*a* and 54*b* pass through the cylindrical aperture 56. Once the radial tabs 54*a* and 54*b* have passed through the cylindrical aperture 56, the portions 52*a* and 52*b* of the split post return to their undeflected positions so the radial tabs 54*a* and 54*b* may engage the outer surface of bottom of the bracket portion 30, thereby releasably retaining the cup holder portion 20 thereto.

Figure 3A:
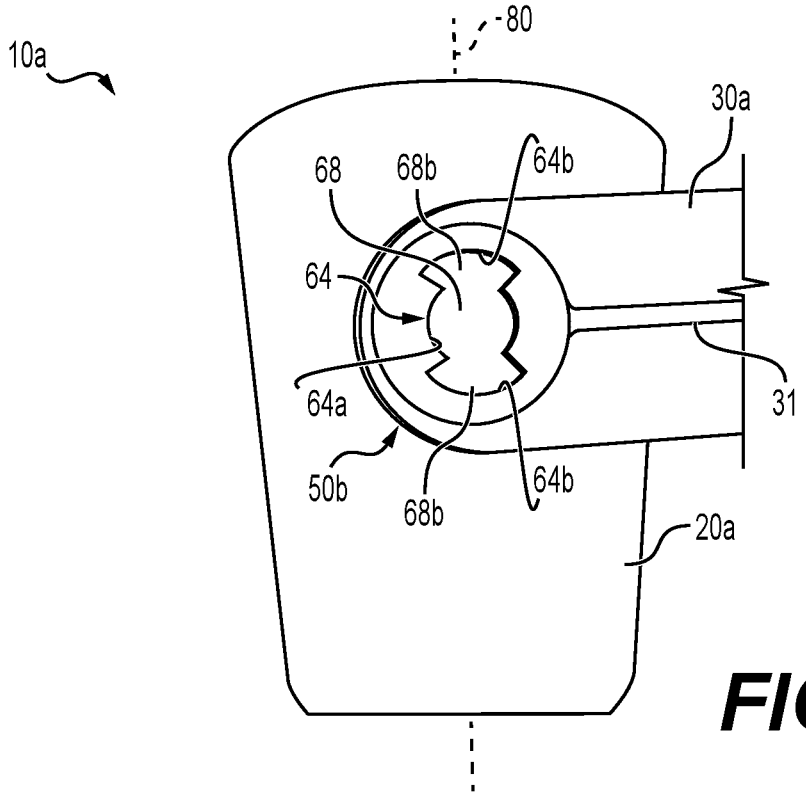
FIGS. 3A through 3D are perspective views of an exemplary cup holder assembly in accordance with yet another alternate embodiment of the present invention.
Figure 3B:
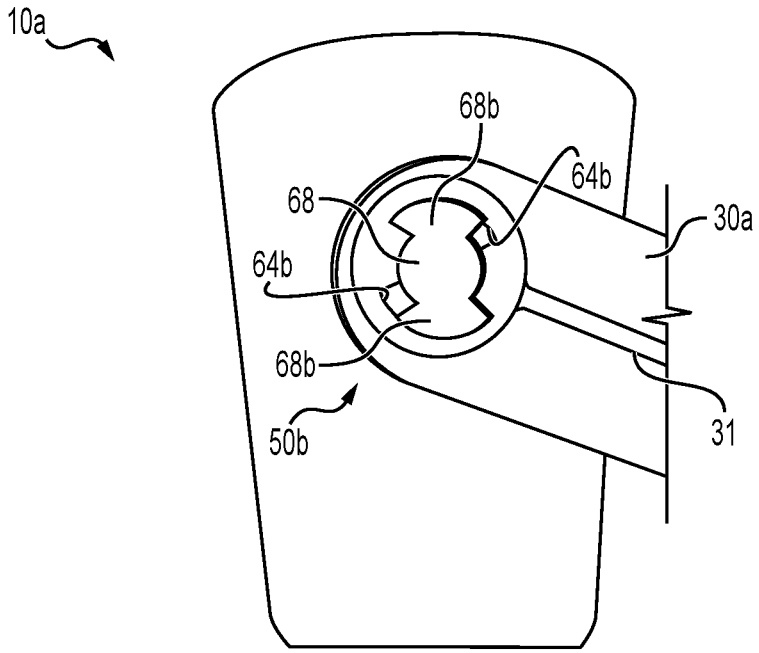
Figure 3C:
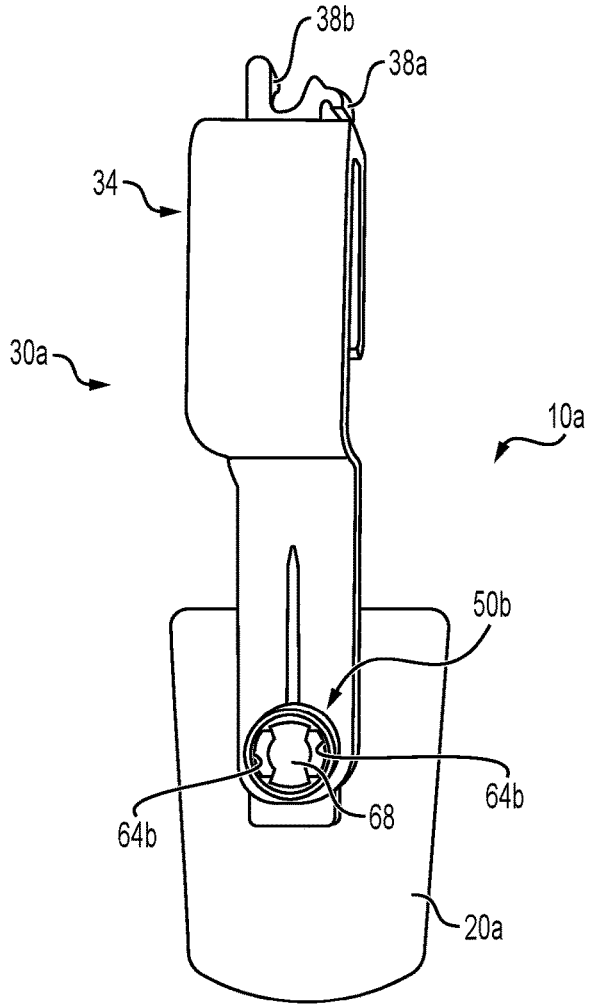
Figure 3D:
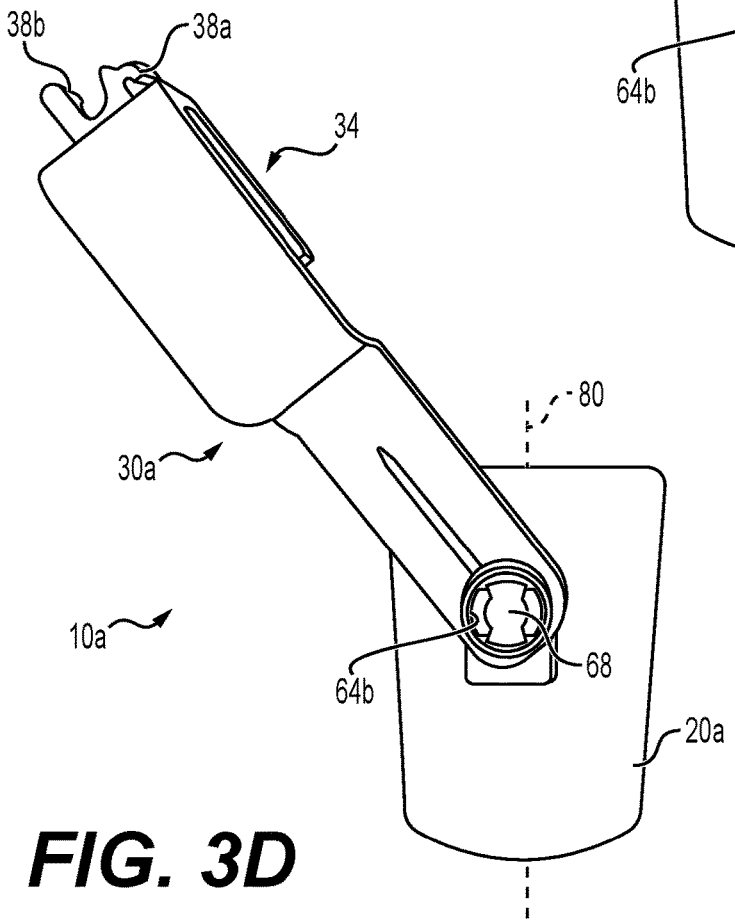

Referring now to FIGS. 3A through 3D, an alternate embodiment of a cup holder assembly 10*a* in accordance with the present disclosure includes a retention feature 50*b* in the form of a stationary post 68 that is received in a corresponding aperture 64 formed in the bottom-most portion of the bracket portion 30. As best seen FIGS. 3A and 3B, the post 68 of the retention feature 50*b* extends radially outwardly from the outer surface of the cup holder portion 20*a* and includes a pair of tabs 68*b* that extend radially-outwardly from a distal end of the post 68. The corresponding aperture 64 includes a substantially cylindrical central portion 64*a* and a pair of side portions 64*b* that are configured to slidably receive the radial tabs 68*b* therethrough. Once the post 68 has been inserted in the aperture 64 so that the radial tabs 68*b* extend outwardly beyond the outer surface of the bracket portion 30*a*, the bracket portion 30*a* may be rotated with respect to the cup portion 20*a* so that the side portions 64*b* of the aperture 64 are no longer aligned with the radially extending tabs 68*b*. As such, the post 68 is prevented from passing back through the aperture 64, and the bracket portion 30*a* is releasably connected to the cup holder portion 20*a*. To remove the bracket portion 30*a* from the cup holder portion 20*a*, the user simply has to align the radial tabs 68*b* with the side portions 64*b* of the aperture 64 and urge the bracket portion 30*a* axially away from the cup portion 20*a*. As shown in FIG. 3A, removal and installation of the bracket portion 30*a* to the cup holder portion 20*a* is achieved when the bracket portion 30*a* is substantially perpendicular to a longitudinal center axis 80 of the cup holder portion 20*a*, as this is not a position of the two components that is attained during normal usage of the cup holder assembly 10.

Unlike the previously discussed embodiment, the embodiment of the cup holder assembly 10*a* shown in FIGS. 3A through 3D has a substantially solid side wall 26 and bottom wall. This configuration facilitates using the cup holder assembly 10*a* to hold small objects such as, but limited to, cell phones, pens, pencils, medications, and the like. Note, use of translucent or transparent material in forming the cup holder portion may allow the graduated measurements 73 on the side of the hydration jug 70 stored therein to be viewed by a user or caregiver.

In some aspects, the bracket portion 30*a* is preferably coupled to the cup holder portion 20*a* above a center of gravity of the cup holder portion 20*a* so that the cup holder portion 20*a* remains vertically oriented and upright by pivoting with respect to the bracket portion 30*a*. In some aspects, the cup holder portion 20*a* and a cup received therein can have a combined weight that is sufficient to cause the cup holder portion 20*a* to pivot relative to the bracket portion 30*a* to orient the top opening upwardly (i.e., the longitudinal center axis 80 of the cup holder portion 20*a* is vertical). In some aspects, the cup holder portion 20*a* can have a weight that is sufficient to cause the cup holder portion 20*a* to pivot relative to the bracket portion 30*a* to orient the top opening upwardly.

Embodiments of the disclosed cup holder assemblies 10, 10*a* may be produced by methods such as, but not limited to, 3D printing. For example, when producing a cup holder assembly 10, 10*a* with a fused deposition modelling (FDM) printer, polyacetic acid (PLA) material may be preferably selected, although other materials may be used. In exemplary aspects, the files for the cup holder portion 20, 20*a* should be oriented vertically, and the file for the bracket portion 30, 30*a* should be oriented with the body portion 36 contacting the support surface so that the hook 34 extends upwardly therefrom as the hook 34 is printed. Preferably, at least 40% infill should be used with FDM printers when printing the cup holder assemblies.

Although the foregoing invention has been described in some detail by way of illustration and example for purposes of clarity of understanding, certain changes and modifications may be practiced within the scope of the appended claims.

What is claimed is:

1. An assembly for coupling to an attachment structure, the assembly comprising a cup holder having a top opening and defining an interior that is configured to receive and hold at least a portion of a cup; and a bracket that is pivotably coupled to the cup holder about a horizontal axis so that the top opening faces upwardly, wherein the bracket comprises a coupling structure that is configured to couple to an attachment structure, wherein the bracket comprises:

an arm portion that is pivotably coupled to the cup holder, the arm portion having a distal end; and a hook portion having a first end and a second end, wherein the first end is attached to the arm portion, wherein, moving along the hook portion from the first end to the second end, the hook portion:

extends outwardly from the arm portion along a horizontal axis away from the cup holder portion, extends upwardly above the distal end of the arm portion, extends toward the cup holder portion along the horizontal axis, and extends downwardly toward the arm portion, wherein the hook portion of the bracket defines the coupling structure.

2. The assembly of claim 1, wherein the interior of the cup holder is configured to receive and hold at least a portion of a hospital hydration jug.

3. The assembly of claim 1, wherein the bracket comprises at least one straw retaining feature that is configured to releasably receive a straw.

4. An assembly for coupling to an attachment structure, the assembly comprising a cup holder having a top opening and defining an interior that is configured to receive and hold at least a portion of a cup; and a bracket that is pivotably coupled to the cup holder about a horizontal axis so that the top opening faces upwardly, wherein the bracket comprises a coupling structure that is configured to couple to an attachment structure, wherein the bracket comprises a first straw retaining feature and a second straw retaining feature, wherein the first straw retaining feature is configured to releasably receive a modular hose, wherein the second straw retaining feature is configured to releasably receive a cylindrical straw.

5. The assembly of claim 4, wherein the modular hose is a LOC-LINE® modular hose.

6. The assembly of claim 1, wherein the hook portion of the bracket comprises:

a first portion that extends outwardly from the cup holder along the horizontal axis;

a second portion having a first end and a second end, wherein the second portion extends upwardly from the first portion at the first end of the second portion;

a third portion having a first end and a second end, wherein the third portion extends inwardly toward the cup holder along the horizontal axis so that the first end of the third portion meets the second end of the second portion; and a fourth portion that extends downwardly from the second end of the third portion.

7. The assembly of claim 6, wherein the hook portion further comprises an inwardly extending projection that extends inwardly from the fourth portion.

8. The assembly of claim 1, wherein the coupling structure is resiliently deformable to receive a rail of a hospital bed therein.

9. The assembly of claim 1, wherein the bracket is removably coupled to the cup holder.

10. The assembly of claim 9, wherein the cup holder comprises a retention feature, wherein the bracket comprises an aperture that, when rotationally aligned with the retention feature, allows the retention feature to pass there through.

11. The assembly of claim 1, wherein the bracket couples to the cup holder above a center of gravity of the cup holder.

12. The assembly of claim 1, wherein the cup holder and a cup received therein have a combined weight that is sufficient to cause the cup holder to pivot relative to the bracket to orient the top opening upwardly.

13. The assembly of claim 1, wherein the cup holder has a weight that is sufficient to cause the cup holder to pivot relative to the bracket to orient the top opening upwardly.

14. A combination comprising:

the assembly of claim 1;

a cup within the cup holder; and a straw extending into the interior of the cup.

15. The combination of claim 14, wherein the bracket comprises at least one straw retaining feature that is configured to releasably receive a straw, wherein the straw is retained by the at least one straw retaining feature.

16. A system comprising:

a hospital bed comprising an attachment structure; and the assembly of claim 1, wherein the bracket is coupled to the attachment structure.

17. The system of claim 16, further comprising:

a cup within the cup holder; and a straw extending into the interior of the cup.

18. The assembly of claim 1, wherein the hook portion defines a gap that faces the cup holder.

* * * * *